US005581824A

United States Patent [19]

Crook, Sr.

[11] Patent Number: 5,581,824

[45] Date of Patent: Dec. 10, 1996

[54] TOILET BOWL SAFETY COVER

[76] Inventor: Oliver K. Crook, Sr., 530 Cedar St., Saraland, Ala. 36571

[21] Appl. No.: 618,576

[22] Filed: Mar. 20, 1996

[51] Int. Cl.[6] ..... A47K 13/02

[52] U.S. Cl. ..... 4/253; 4/661; 4/901

[58] Field of Search ..... 4/253, 254, 233, 4/661, 901

[56] References Cited

U.S. PATENT DOCUMENTS

| | | | |
|---|---|---|---|
| 1,793,815 | 2/1931 | McCann | 4/253 |
| 2,558,578 | 6/1951 | Palmiori | 4/253 |
| 2,658,201 | 11/1953 | Sherwood | 4/901 |
| 3,346,888 | 10/1967 | Paysinger | 4/253 |
| 3,524,203 | 8/1970 | Ruggles | 4/661 |
| 4,160,295 | 7/1979 | Putyra | 4/661 |
| 4,221,431 | 9/1980 | Rose | 4/661 |
| 4,469,358 | 9/1984 | Abbott | 292/288 |
| 4,930,166 | 6/1990 | Salloum | 4/253 |
| 5,060,319 | 10/1991 | Laroue | 4/254 |
| 5,067,185 | 11/1991 | Kohler | 4/661 |

*Primary Examiner*—Henry J. Recla
*Assistant Examiner*—Charles R. Eloshway
*Attorney, Agent, or Firm*—Joseph N. Breaux

[57] ABSTRACT

A toilet bowl safety cover including a rigid housing member having a housing cavity having a first portion contoured to receive therein in a close fitting relationship the top portion of the toilet bowl and a toilet bowl base receiving portion contoured to receive therein in close fitting relationship the base of the toilet bowl assembly; and a top seating surface sized to cover the entire opening of the toilet bowl defined by the toilet bowl rim, the seating surface being supported by the rigid housing member with sufficient strength to support a person seated thereon; and a strapping mechanism having first and second strap sections connectable with a coupling mechanism, at least one of the first and second strap sections being configured with a length adjustment mechanism. In use the toilet bowl and toilet base are positioned respectively within the bowl receiving portion and the base receiving portion of the housing cavity. The rigid housing is then secured in place by wrapping the straps around the back section of the toilet bowl connecting the first and second strap sections together and adjusting the length of at least one of the strap sections with the length adjustment mechanism until a snug fit is achieved. The close fit between the housing cavity and the toilet bowl and toilet base prevents lifting of the cover when the strap is secured in place.

8 Claims, 1 Drawing Sheet

TOILET BOWL SAFETY COVER

DESCRIPTION

1. Technical Field

The present invention relates to safety devices used to seal or cover the opening of a toilet bowl and more particularly to a safety device securable over the toilet bowl portion of a toilet assembly that prevents access to the toilet bowl when in place and provides a seating surface not supported by the toilet bowl or the toilet assembly.

2. Background Art

Small children and animals have been known to become killed or injured due to drowning in uncovered water filled toilet bowls. It is desirable, therefore, to securely cover the water filled toilet bowl of the toilet bowl assembly when small children and animals are around to protect the children and animals from dangers associated with the toilet bowl. It is known to provide a strap-type harness arrangement for securing the existing pivoting toilet lid over the toilet bowl. However, this arrangement is unsightly and animals can chew through the harness material to gain access to the toilet bowl. It would be desirable, therefore, to have a safety cover for a toilet bowl that would not destroy the aesthetics of the bathroom decor in which it is used. It is also desirable to have sitting facilities within the bathroom for various reasons. It would be a benefit, therefore, if the safety cover could be utilized as a seating device within the bathroom. It would be desirable if the seating function could be utilized regardless of whether the safety cover was in place over a toilet bowl or not.

GENERAL SUMMARY DISCUSSION OF INVENTION

It is thus an object of the invention to provide a toilet bowl safety cover that does not destroy the aesthetics of the bathroom decor in which it is used.

It is a further object of the invention to provide a toilet bowl safety cover that can be utilized as a seating device within the bathroom regardless of whether the safety cover is in place over a toilet bowl or not.

It is a still further object of the invention to provide a toilet bowl safety cover that accomplishes both of the above objects in combination.

Accordingly, a toilet bowl safety cover is provided. The toilet bowl safety cover comprises a rigid housing member having a housing cavity having a first portion contoured to receive therein in a close fitting relationship the top portion of the toilet bowl and a toilet bowl base receiving portion contoured to receive therein in close fitting relationship the base of the toilet bowl assembly, and a top seating surface sized to cover the entire opening of the toilet bowl defined by the toilet bowl rim, the seating surface being supported by the rigid housing member with sufficient strength to support a person seated thereon; and a strapping mechanism having first and second strap sections connectable with a coupling mechanism, at least one of the first and second strap sections being configured with a length adjustment mechanism. In use the toilet bowl and toilet base are positioned respectively within the bowl receiving portion and the base receiving portion of the housing cavity. The rigid housing is then secured in place by wrapping the strap sections around the back section of the toilet bowl connecting the first and second strap sections together and adjusting the length of at least one of the strap sections with the length adjustment mechanism until a snug fit is achieved. The close fit between the housing cavity and the toilet bowl and toilet base prevents lifting of the cover when the strap is secured in place.

If desired, the rigid housing member can be provided in a color and finish that matches the decor of the bathroom. In addition, when not in use to cover the toilet bowl, the rigid cover member can be positioned in an advantageous position for utilization as a seating device.

BRIEF DESCRIPTION OF DRAWINGS

For a further understanding of the nature and objects of the present invention, reference should be had to the following detailed description, taken in conjunction with the accompanying drawings, in which like elements are given the same or analogous reference numbers and wherein.

EXEMPLARY MODE FOR CARRYING OUT THE INVENTION

Figure 1:
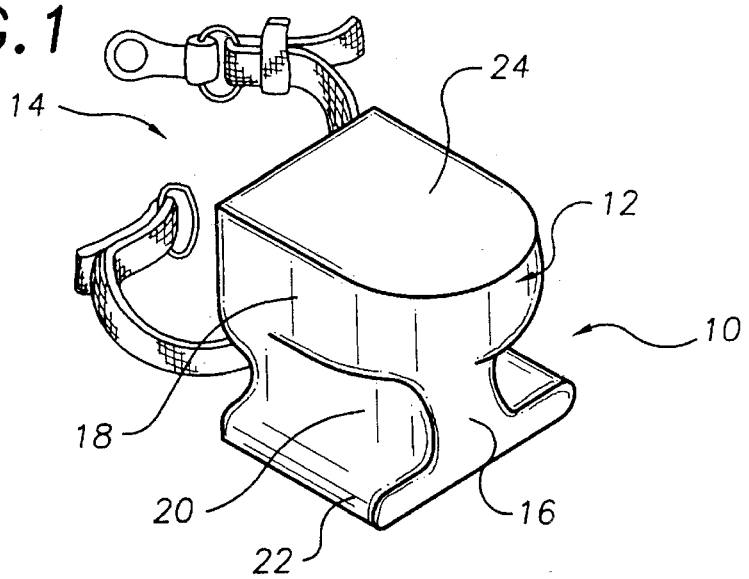
FIG. 1 is a perspective view of an exemplary embodiment of the toilet bowl safety cover of the present invention showing the bowl cover/seat member and the strapping mechanism.

FIG. 1 shows an exemplary embodiment of the toilet bowl safety cover of the present invention generally designated by the numeral 10. Safety cover 10 includes a rigid housing member 12 and a strap mechanism generally designated by the numeral 14. Rigid housing 12 has rigid, three quarter inch thick walls molded from polyethylene plastic and has a smooth exterior surface 16 that is adapted to resemble the conventional porcelain appearance of conventional toilet assemblies. In this embodiment, exterior surface 16 is also contoured to resemble a toilet bowl including a bowl portion 18, a pedestal portion 20 and a base portion 22. Contouring exterior surface 16 camouflages safety cover 10 and gives the visual impression of a conventional toilet assembly. A seating surface 24 is provide at the top of bowl portion 18.

Figure 2:
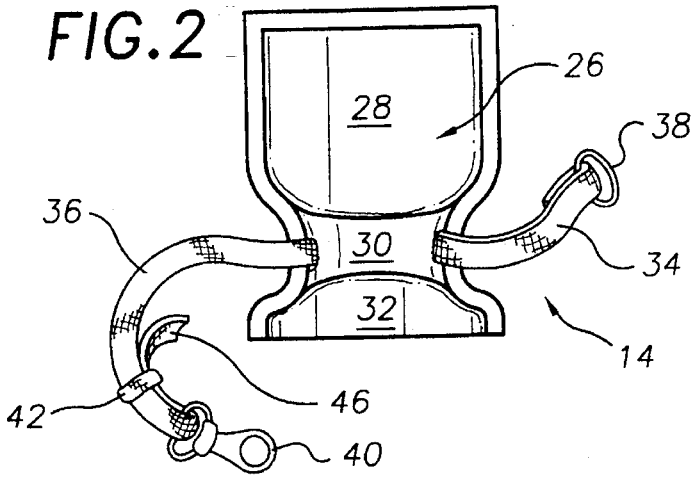
FIG. 2 is a rear plan view of the toilet bowl safety cover of FIG. 1 showing the bowl receiving cavity portion and the base receiving cavity portion.

With reference to FIG. 2, housing member 12 has a housing cavity 26 formed therein composed of a bowl receiving cavity portion 28, a pedestal receiving cavity portion 30, and a base receiving cavity portion 32. Bowl receiving cavity portion 28 and base receiving cavity portion 32 are contoured, respectively, to receive therein in a close fitting relationship the top portion of a toilet bowl and the base of the toilet bowl assembly.

Strap mechanism 14 includes a first strap member 34 and a second strap member 36. First and second strap members 34,36 are secured at first ends thereof to opposed, interior sidewalls defining pedestal receiving portion 30 of housing cavity 26. First strap member 34 has a metal O-ring 38 secured to a second end thereof. O-ring 38 interlocks with a conventional snap ring mechanism 40 that is secured to second strap member 36. A buckle 42 that functions as a length adjustment mechanism is provided on second strap member 36. The length of second strap member 36 between the first end thereof and snap ring mechanism 42 is reduced by pulling on the second end 46 of second strap member 36 after O-ring 38 and snap ring mechanism 40 are engaged.

Figure 3:
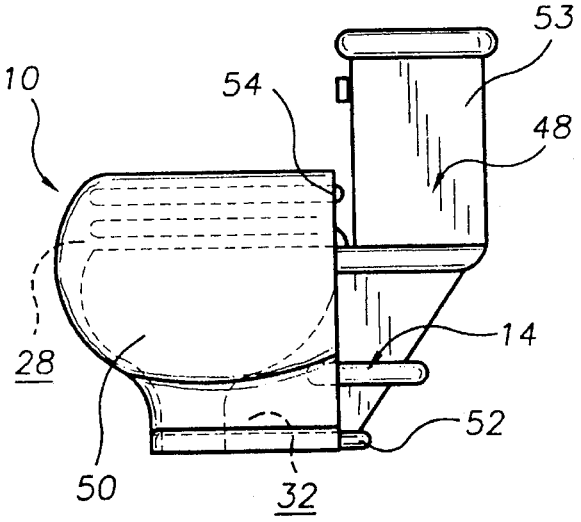
FIG. 3 is a side plan view of the toilet bowl safety cover in use with a representative toilet bowl assembly showing the the bowl of the representative toilet bowl assembly positioned within the bowl receiving cavity portion, the base of the toilet in the base receiving cavity portion and the securing strap secured about the back of the toilet bowl.
Figure 4:
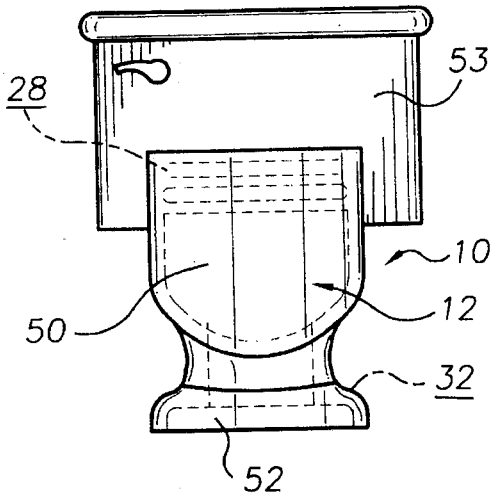
FIG. 4 is a front plan view of the toilet bowl safety cover in use with the representative toilet bowl assembly showing the bowl of the representative toilet bowl assembly positioned within the bowl receiving cavity portion and the base of the toilet in the base receiving cavity portion.

Use of safety cover 10 is now described with general reference to FIGS. 1–4. FIG. 3 shows safety cover 10 in use with a representative toilet bowl assembly 48. Toilet bowl assembly 48 includes a toilet bowl 50, a base 52 and a tank assembly 53. Toilet bowl 50 and base 52 are shown respectively positioned within bowl receiving cavity portion 28 and pedestal receiving cavity portion 32. Safety cover 10 is used by placing housing member 12 over toilet bowl 10 and securing it in place by connecting strap mechanism 14 around tank assembly 53 and reducing the length of second strap member 36, as previously discussed, until first and second strap members are taut.

Housing member 12 is positioned over toilet bowl 50 and base 52 by positioning housing member 12 onto the floor in front of toilet bowl 50 and sliding housing member 12 toward tank assembly 53 until the rear edge 54 of housing member 12 is as close to tank assembly 53 as it will go. Once housing member 12 is in place, strap mechanism 14 is used to hold it firmly in place. Because bowl receiving cavity portion 28 and base receiving cavity portion 32 are contoured, respectively, to receive toilet bowl 50 and base 52, housing member 12 can not be removed by simply lifting housing member 12 in an upward direction. When it is not desired to utilized safety cover 10 to cover toilet bowl 50, safety cover 10 may used as a seating device.

It can be seen from the preceding description that a toilet bowl safety cover has been provided that does not destroy the aesthetics of the bathroom decor in which it is used; and that can be utilized as a seating device within the bathroom regardless of whether the safety cover is in place over a toilet bowl or not.

It is noted that the embodiment of the toilet bowl safety cover described herein in detail for exemplary purposes is of course subject to many different variations in structure, design, application and methodology. Because many varying and different embodiments may be made within the scope of the inventive concept(s) herein taught, and because many modifications may be made in the embodiment herein detailed in accordance with the descriptive requirements of the law, it is to be understood that the details herein are to be interpreted as illustrative and not in a limiting sense.

What is claimed is:

1. A toilet bowl safety cover comprising:

a rigid housing member having a housing cavity having a first portion contoured to receive therein in a close fitting relationship a top portion of a toilet bowl and a toilet bowl base receiving portion contoured to receive therein in close fitting relationship a base of said toilet bowl, and a top seating surface sized to completely cover an opening of said toilet bowl defined by a toilet bowl rim, said seating surface being supported by said rigid housing member with sufficient strength to support a person seated thereon; and a strapping mechanism connected to said rigid housing member and having first and second strap sections connectable with a coupling mechanism, at least one of said first and second strap sections being configured with a length adjustment mechanism.

2. The toilet bowl safety cover of claim 1, wherein:

said rigid housing member has a smooth exterior surface adapted to resemble a surface of a conventional toilet assembly.

3. Said toilet bowl safety cover of claim 2, wherein:

said rigid housing member has an exterior surface contoured to resemble a toilet bowl.

4. The toilet bowl safety cover of claim 3 wherein:

said coupling mechanism includes an O-ring secured to one of said first and second strap sections and a snap ring mechanism secured to the other of said first and second strap section.

5. The toilet bowl safety cover of claim 2 wherein:

said coupling mechanism includes an O-ring secured to one of said first and second strap sections and a snap ring mechanism secured to the other of said first and second strap section.

6. Said toilet bowl safety cover of claim 1, wherein:

said rigid housing member has an exterior surface contoured to resemble a toilet bowl.

7. The toilet bowl safety cover of claim 6 wherein:

said coupling mechanism includes an O-ring secured to one of said first and second strap sections and a snap ring mechanism secured to the other of said first and second strap section.

8. The toilet bowl safety cover of claim 1 wherein:

said coupling mechanism includes an O-ring secured to one of said first and second strap sections and a snap ring mechanism secured to the other of said first and second strap section.

* * * * *